US011859852B2

(12) United States Patent
Sakal

(10) Patent No.: US 11,859,852 B2
(45) Date of Patent: Jan. 2, 2024

(54) AIR CONDITIONER WITH MODULAR MAKEUP AIR ASSEMBLY

(71) Applicant: Haier US Appliance Solutions, Inc., Wilmington, DE (US)

(72) Inventor: Eric Ormsby Sakal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 323 days.

(21) Appl. No.: 17/229,994

(22) Filed: Apr. 14, 2021

(65) Prior Publication Data

US 2022/0333814 A1 Oct. 20, 2022

(51) Int. Cl.
*F24F 13/02* (2006.01)
*F24F 13/30* (2006.01)

(52) U.S. Cl.
CPC ..... *F24F 13/0254* (2013.01); *F24F 13/029* (2013.01); *F24F 13/30* (2013.01)

(58) Field of Classification Search
CPC ..... F24F 13/30; F24F 13/28
USPC ..... 454/358
See application file for complete search history.

(56) References Cited

U.S. PATENT DOCUMENTS 3,494,113 A * 2/1970 Kinney ..... B01D 46/0005 55/497
3,729,951 A 5/1973 Berger
3,831,395 A * 8/1974 Levy ..... F24F 1/035 62/297
5,485,878 A * 1/1996 Derks ..... F24F 3/044 165/250
7,162,889 B2 1/2007 Hwang
7,332,019 B2 * 2/2008 Bias ..... B03C 3/72 96/26
9,383,115 B2 7/2016 Fu
9,696,044 B2 7/2017 Shaffer
9,739,497 B2 8/2017 Dobbs
10,663,197 B2 5/2020 Cagle

FOREIGN PATENT DOCUMENTS

CN 202040931 U 11/2011
CN 111023538 A 4/2020
TW M346766 U 12/2008
WO WO2020010780 A1 1/2020

* cited by examiner

*Primary Examiner* — Allen R. B. Schult
(74) *Attorney, Agent, or Firm* — Dority & Manning, P.A.

(57) ABSTRACT

An air conditioner unit includes a housing defining an outdoor portion and an indoor portion. An outdoor heat exchanger assembly is disposed in the outdoor portion and an indoor heat exchanger assembly is disposed in the indoor portion. The air conditioner unit also includes a compressor in fluid communication with the outdoor heat exchanger assembly and the indoor heat exchanger assembly to circulate a refrigerant therebetween. The air conditioner unit further includes a plenum attached to the housing. The plenum is receivable within a wall channel defined by a structure wall along an axial direction. The air conditioner unit also includes a make-up air duct extending between the plenum and the indoor portion of the housing with a bracket fixed in place within the make-up air duct and a make-up air component slidably received in the bracket. The make-up air component is slidably removable from the bracket.

20 Claims, 15 Drawing Sheets

AIR CONDITIONER WITH MODULAR MAKEUP AIR ASSEMBLY

FIELD OF THE INVENTION

The present subject matter relates generally to air conditioning appliances, and more particularly to makeup air assemblies for air conditioning appliances.

BACKGROUND OF THE INVENTION

Air conditioner or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Make-up air, e.g., additional fresh air from outside of the building, is typically provided either with a large separate system remote from the air conditioner or with make-up air components internal to the air conditioner. Conventional separate systems can be costly. Conventional internal systems must be relatively small due to limited volume within the air conditioner, which may result in limited capacity of the make-up air system, e.g., limited size of the make-up air components. The limited volume may result in a limited number of fixed locations in which each component of the make-up air system may be positioned.

As a result, further improvements to air conditioners may be advantageous. In particular, it would be useful to provide a make-up air system with components that can be quickly and easily removed or replaced and/or where the position or size of the make-up air components are readily changed in the design of the make-up air system.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioner unit is provided. The air conditioner unit defines a mutually-perpendicular vertical direction, lateral direction, and transverse direction. The air conditioner unit includes a housing that defines an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. A plenum is attached to the housing. The plenum is receivable within a wall channel defined by a structure wall along an axial direction. The air conditioner unit also includes a make-up air duct extending between the plenum and the indoor portion of the housing. A plurality of brackets are fixed in place within the make-up air duct. The air conditioner unit further includes a plurality of make-up air components. Each make-up air component of the plurality of make-up air components is slidably received in one corresponding bracket of the plurality of brackets. The make-up air components are each removable from the corresponding bracket of the plurality of brackets.

In another exemplary aspect of the present disclosure, an air conditioner unit is provided. The air conditioner unit includes a housing defining an outdoor portion and an indoor portion. An outdoor heat exchanger assembly is disposed in the outdoor portion and includes an outdoor heat exchanger and an outdoor fan. An indoor heat exchanger assembly is disposed in the indoor portion and includes an indoor heat exchanger and an indoor fan. The air conditioner unit also includes a compressor in fluid communication with the outdoor heat exchanger and the indoor heat exchanger to circulate a refrigerant between the outdoor heat exchanger and the indoor heat exchanger. The air conditioner unit further includes a plenum attached to the housing. The plenum is receivable within a wall channel defined by a structure wall along an axial direction. The air conditioner unit also includes a make-up air duct extending between the plenum and the indoor portion of the housing with a bracket fixed in place within the make-up air duct and a make-up air component slidably received in the bracket. The make-up air component is slidably removable from the bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
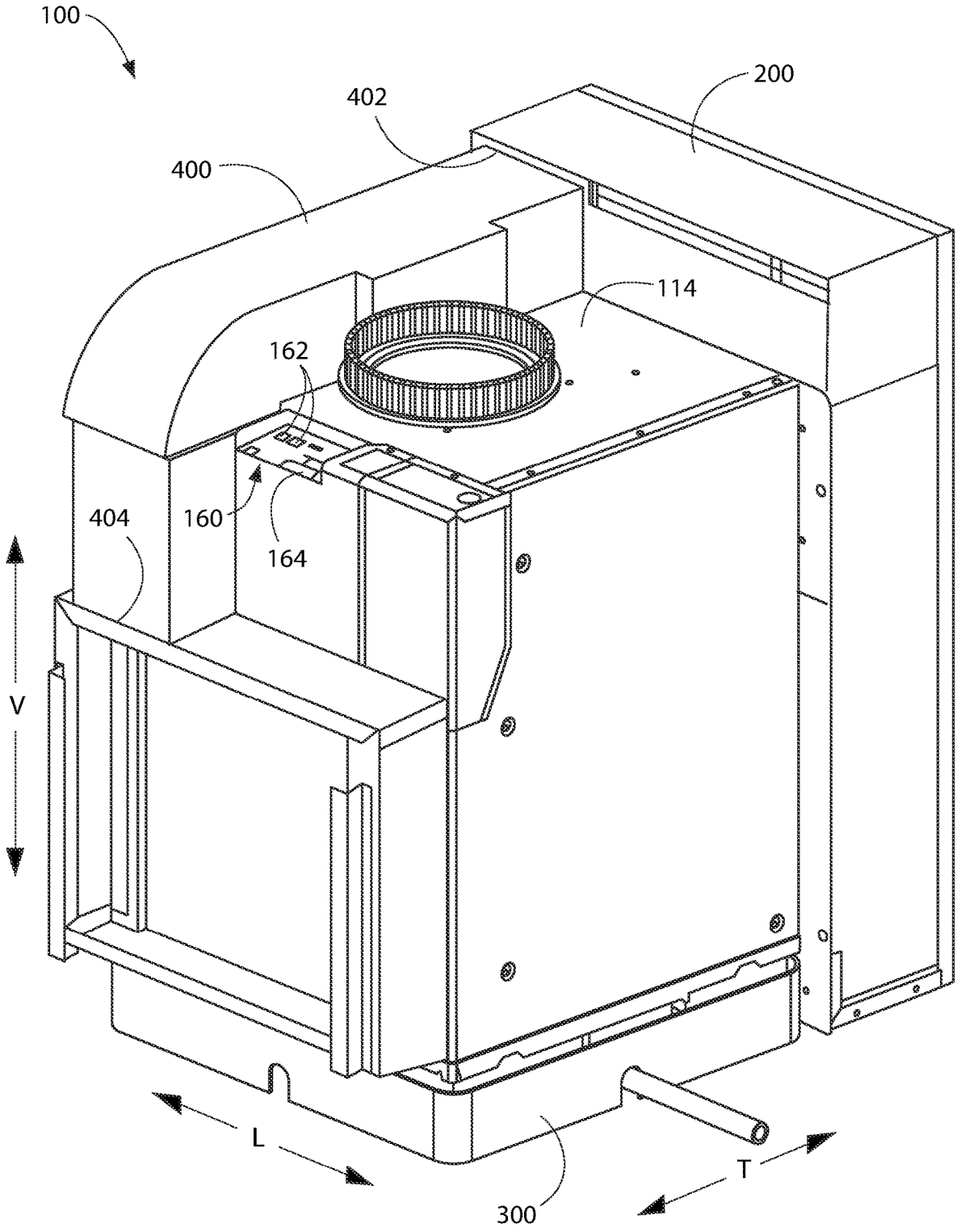
FIG. 1 provides a perspective view of an air conditioner unit according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
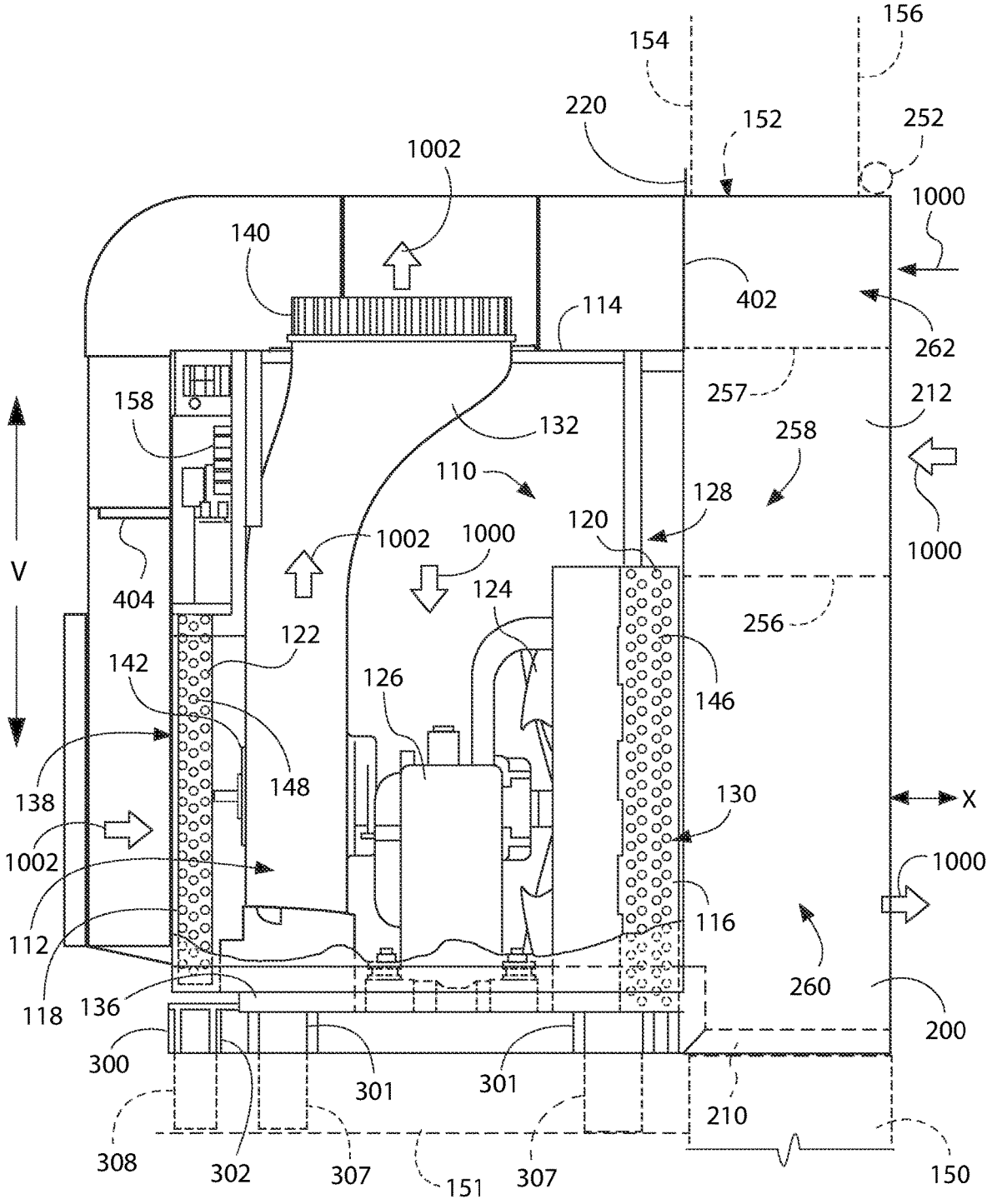
FIG. 2 provides a section view of the air conditioner unit of FIG. 1 according to one or more exemplary embodiments of the present disclosure.

Turning now to the figures, FIGS. 1 and 2 illustrate an exemplary air conditioner appliance or air conditioner unit (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is mutually perpendicular with every other direction, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 may be part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components are mounted on a base 136, as shown. The base 136 may be received on or within a drain pan 300.

During certain operations, air 1000 may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 112 may include an indoor heat exchanger 122, and an indoor fan 142, e.g., a blower fan 142 as in the illustrated example embodiment. These components may, for example, be housed behind the front opening 118. A bulkhead may generally support or house various other components or portions thereof of the indoor portion 112, such as the blower fan 142. The bulkhead may generally separate and define the indoor portion 112 and outdoor portion 110 within housing 114.

During certain operations, air 1002 may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 before passing to a duct 132. The indoor air 1002 may be motivated (e.g., by fan 142) into and through the duct 132 and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air 1002 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchangers 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated to perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base 136) and an expansion device (e.g., expansion valve or capillary tube—not pictured), both of which may be in fluid communication with the heat exchangers 120, 122 to flow refrigerant therethrough, as is generally understood. The outdoor and indoor heat exchangers 120, 122 may each include coils 146, 148, as illustrated, through which a refrigerant may flow for heat exchange purposes, as is generally understood.

A plenum 200 may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed) and above a floor 151. In particular, plenum 200 extends along an axial direction X (e.g., parallel to the transverse direction T) through a hole or channel 152 in the structure wall 150 that passes from an internal surface 154 to an external surface 156. Optionally, a caulk bead 252 (i.e., adhesive or sealant caulk) may be provided to join the plenum 200 to the external surface 156 of structure wall 150 (e.g., about or outside from wall channel 152).

The plenum 200 includes a duct wall 212 that is formed about the axial direction X (e.g., when mounted through wall channel 152). Duct wall 212 may be formed according to any suitable hollow shape, such as conduit having a rectangular profile (shown), defining an air channel 210 to guide air therethrough. Moreover, duct wall 212 may be formed from any suitable non-permeable material (e.g., steel, aluminum, or a suitable polymer) for directing or guiding air therethrough. In certain embodiments, plenum 200 further includes an outer flange 220 that extends in a radial direction (e.g., perpendicular to the axial direction X) from duct wall 212. Specifically, outer flange 220 may extend radially outward (e.g., away from at least a portion of the axial direction X or the duct wall 212).

In some embodiments, plenum 200 includes a divider wall 256 within air channel 210. When assembled, divider wall 256 defines a separate upper passage 258 and lower passage 260. For instance, divider wall 256 may extend along the lateral direction L from one lateral side of plenum 200 to the other lateral side. Generally, upper passage 258 and lower passage 260 may divide or define two discrete air flow paths for air channel 210. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130.

The plenum 200 may further include a second divider wall 257 which separates a make-up air passage 262 from the remainder of the air channel 210, such as from the upper passage 258 and the lower passage 260. For example, the make-up air passage 262 may be positioned directly above the upper passage 258, whereby the second divider separates and partially defines the make-up air passage 262 and the upper passage 258, e.g., as in the exemplary embodiment illustrated in FIG. 2. Similar to the divider wall 256 described above, the second divider wall 257 may extend along the lateral direction L from one lateral side of plenum 200 to the other lateral side. The make-up air passage 262 may thereby define a discrete air flow path within air channel 210 which is separate and distinct from the upper and lower passages 258 and 260. When assembled, the make-up air passage 262 may be fluidly isolated by the second divider wall 257 from one or both of the upper passage 258 and lower passage 260, e.g., such that air is prevented from passing directly between the make-up air passage 262 and the upper and lower passages 258 and 260 through the second divider wall 257, or any other portion of plenum 200). The make-up air passage 262 may be positioned upstream from a make-up air duct 400. In some embodiments, outdoor air 1000 may be drawn into the make-up air duct 400 by a make-up air fan, e.g., muffin fan 406 (see, e.g., FIGS. 3 and 4), via the make-up air passage 262. The make-up air duct 400 may extend from a first end 402 at the make-up air passage 262 of the plenum 200 to a second end 404 at the indoor portion 112 of the housing 114, e.g., upstream of the indoor inlet 138, whereby outdoor air, e.g., make-up air, may be provided directly to the indoor portion 112 of the air conditioner 100 via the make-up air duct 400. Thus, the make-up air duct 400 may be a component of a make-up air system or make-up air assembly, which will be described in more detail below.

The operation of air conditioner 100 including compressor 126 (and thus the sealed system generally), indoor fan 142, outdoor fan 124, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 (FIG. 1) and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Also as may be seen in FIG. 2, in some instances when the plenum 200 is installed within the wall 150 above the floor 151, the remainder of the air conditioner unit 100 may be suspended or cantilevered from the plenum 200. In order to avoid such cantilever, one or more support legs 307 and/or 308 may be provided between the drain pan 300 and the floor 151, whereby at least some of the weight of the remaining components of the air conditioner unit 100 is shifted off of the plenum 200. Where the installation height of the plenum 200 above the floor 151 varies, the required height of the leg(s) 307 and/or 308 will also vary. Thus, the leg(s) 307 and/or 308 may be cut in the field and custom-fitted to the specific installation.

The drain pan 300 may include one or more sockets which are configured to receive the leg(s) 307 and/or 308. For example, as illustrated in FIG. 2, the drain pan 300 may include a first socket 301 and a second socket 302. As illustrated in FIG. 2, the socket(s) 301 and/or 302 may be positioned opposite the plenum 200 along the transverse direction T. For example, the plenum 200 may be positioned at a first transverse end of the drain pan 300 and the socket(s) 301/302 may be positioned opposite the plenum 200 at or near a second transverse end of the drain pan 300. Also as may be seen in FIG. 2, in some embodiments the drain pan 300 may also or instead include one or more of the sockets 301 and/or 302 at the other end of the pan 300, e.g., proximate the plenum 200. In various embodiments, one or both of the sockets 301 and 302 may be provided. In some embodiments, each socket 301 and 302 may be one of a pair of matching shaped sockets which are spaced apart along the lateral direction L and aligned along the transverse direction T.

The material for the leg(s) 307 and/or 308 may be any suitable material which is strong enough to bear the weight of the housing 114 and drain pan 300. For example, materials which are likely to be readily available during installation of the air conditioner unit and which can be suitable for forming the leg(s) 307 and/or 308 include building materials such as lumber, e.g., dimensional lumber such as a nominal two-inch-by-four-inch board, commonly referred to as a two-by-four, or plumbing, e.g., PVC piping having sufficient size (e.g., outer diameter, wall thickness, etc.). Thus, in some embodiments, the socket, e.g., first socket 301, may have a rectangular cross-section and may thereby be configured to receive a leg 307 made of lumber, such as a two-by-four leg, a two-by-six leg, or a four-by-four leg, etc. Additionally, in some embodiments, the socket, e.g., the second socket 302, may be cylindrical and may thereby be configured to receive a round, e.g., cylindrical, leg 308, such as a piece of piping, e.g., a PVC pipe as mentioned above, or, as another example, a steel pipe or other tubular or solid round leg 308.

Figure 3:
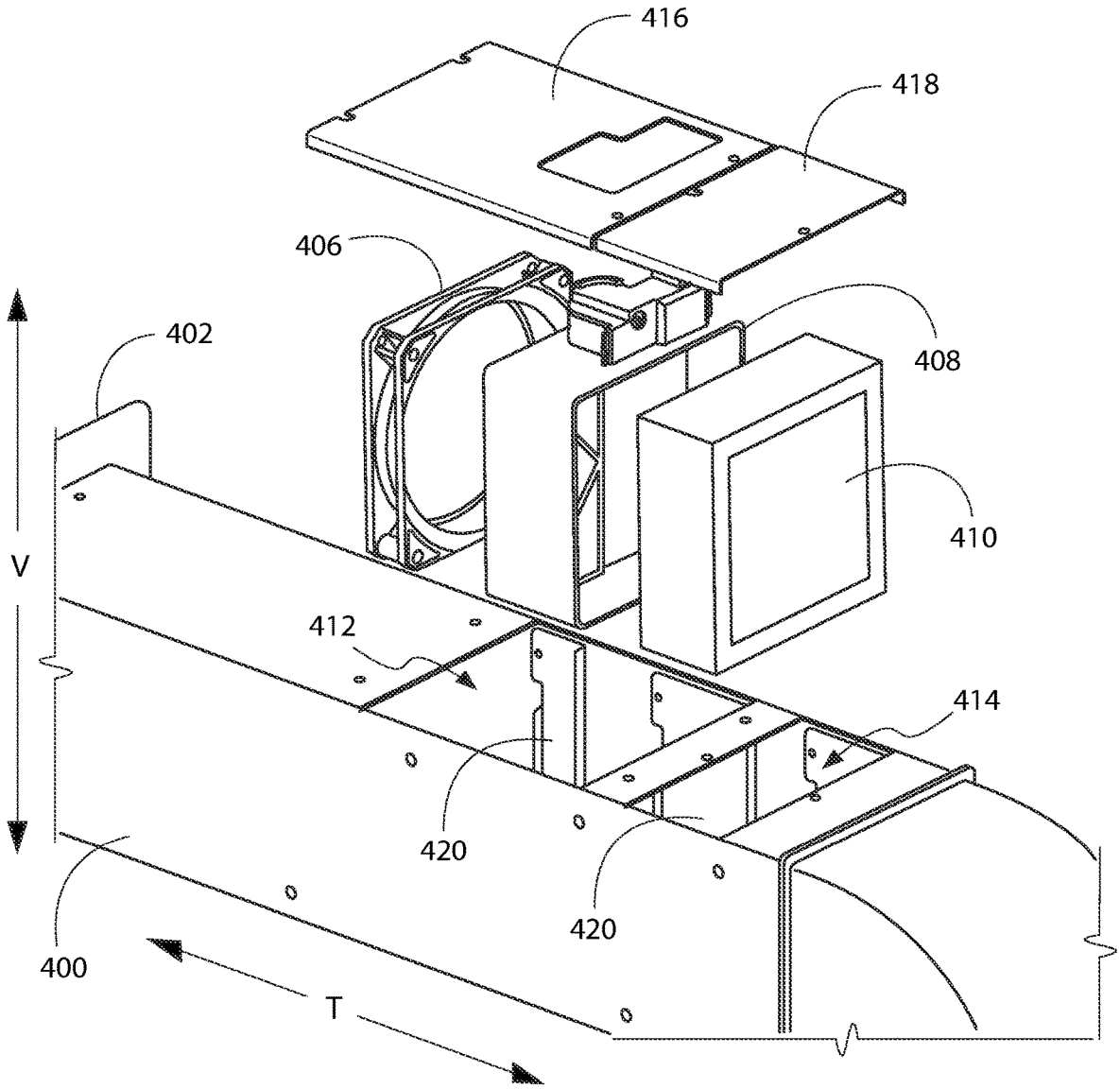
FIG. 3 provides an exploded perspective view of a portion of a make-up air system according to one or more exemplary embodiments of the present disclosure which may be incorporated into an air conditioner unit such as the air conditioner unit of FIG. 1.
Figure 4:
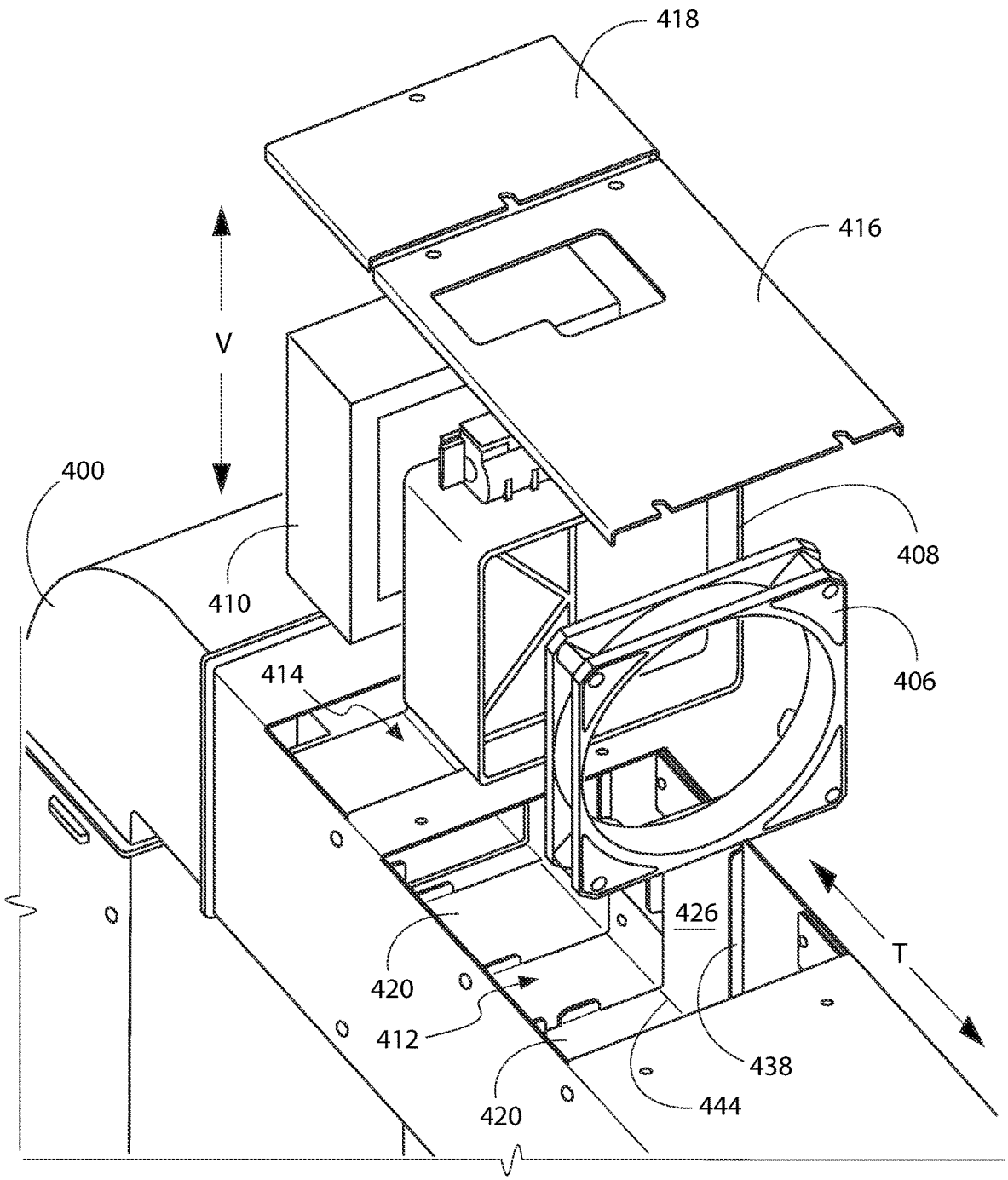
FIG. 4 provides another exploded perspective view of a portion of a make-up air system according to one or more exemplary embodiments of the present disclosure which may be incorporated into an air conditioner unit such as the air conditioner unit of FIG. 1.

As mentioned above, the air conditioner 100 may include a make-up air assembly. Portions of the make-up air assembly according to one or more embodiments of the present disclosure are illustrated in various perspective views in FIGS. 3 through 8. For example, FIGS. 3 and 4 provide perspective views of portions of the make-up air duct 400 with a plurality of make-up air components, e.g., a muffin fan 406, a damper 408, and a filter 410, and a pair of covers 416 and 418. Only the outer frame of the muffin fan 406 is illustrated, in order to depict the manner in which the fan 406 fits within and interacts with the duct 400, cover 416, and a corresponding bracket 420 (see, e.g., FIGS. 7 and 8 regarding the brackets 420). Internal components of the fan 406, e.g., blades and a motor, the structure and function of which are well understood by those of ordinary skill in the art, are omitted for the sake of clarity. Additionally, it should be understood that the muffin fan 406, the damper 408, and the filter 410 illustrated in FIGS. 3 and 4 are by way of example only. In various embodiments of the present disclosure, the plurality of make-up air components may include any two or more of the illustrated components, such as multiples of the same component, e.g., two or more fans 406 (such as multiple fans in series), separately or in combination with one or more of the other exemplary make-up air components shown in the accompanying FIGS. and described herein.

Figure 5:
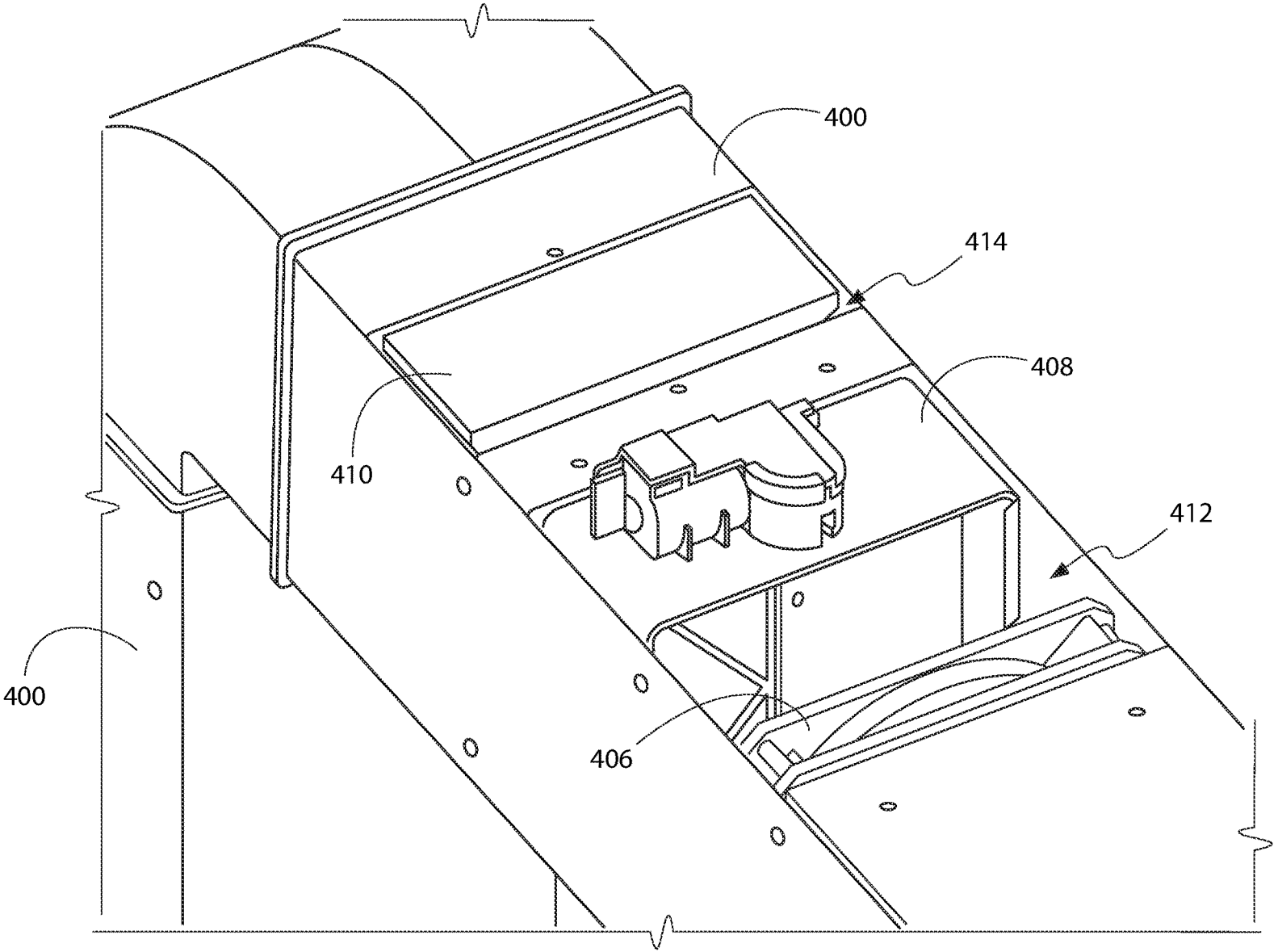
FIG. 5 provides a perspective view of the make-up air system with make-up air components thereof received within a make-up air duct of the make-up air system.
Figure 6:
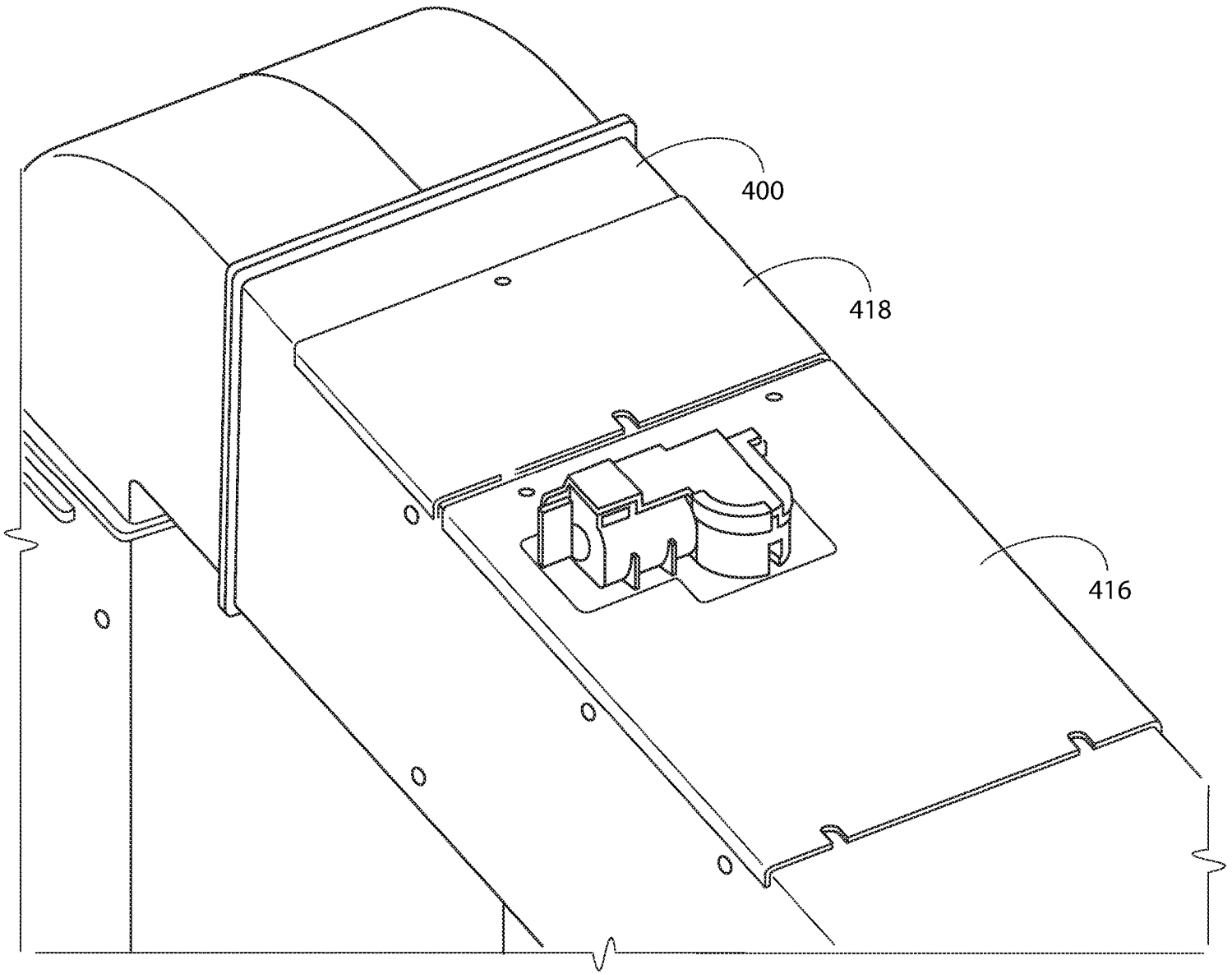
FIG. 6 provides a perspective view of the make-up air system with a cover installed on the make-up air duct.

As will be explained in more detail below, the make-up air assembly may be modular, e.g., in that one or more of the make-up air components 406, 408, and/or 410 may be slidably received within the make-up air duct 400 and a corresponding bracket or brackets 420 therein, and may be removable therefrom, such as removable without undoing any mechanical fasteners such as screws or bolts etc., and/or without releasing any retention clip, clamp or other connection. In some embodiments, the make-up air components may be inserted into the duct 400 and removed from the duct 400 through one or more openings in the duct 400, such as a first opening 412 through which the fan 406 and damper 408 are inserted and/or removed and a second opening 414 through which the filter 410 is inserted and/or removed. For example, the one or more make-up air components 406, 408, and/or 410 may be unconstrained by the duct 400 and bracket(s) 420 in at least one direction of movement, e.g., upwards along the vertical direction V, for insertion and/or removal of the component into and out of the duct 400 and bracket 420. For example, in some embodiments, all of the make-up air components, e.g., all three of the fan 406, damper 408, and filter 410, may be slidably received in a corresponding bracket 420 (e.g., with a one-to-one correspondence between components and brackets, one component in each bracket and one bracket for each component) and may be removable therefrom. For example, FIG. 5 illustrates the make-up air components in an installed and removable position, e.g., were the make-up air components are each received within a corresponding bracket 420 within the duct 400 and are unconstrained by the duct 400 and brackets 420 against upward movement along the vertical direction. As illustrated in FIG. 6, the make-up air components may be fully enclosed and secured in place within the duct 400 by the one or more covers, e.g., covers 416 and 418, over the respective one or more openings, e.g., openings 412 and 414.

Figure 7:
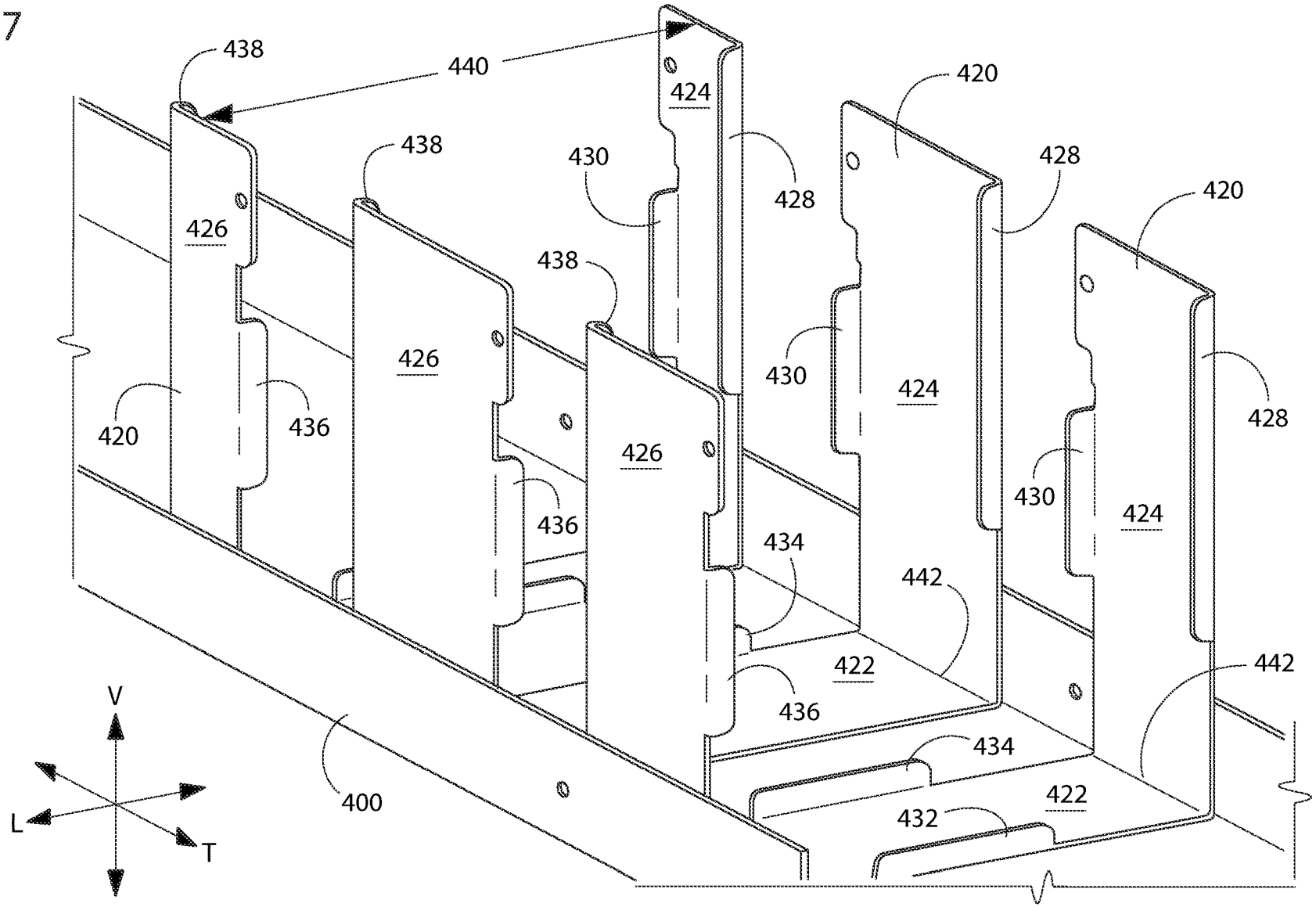
FIG. 7 provides a perspective view of a plurality of brackets of the make-up air system.
Figure 8:
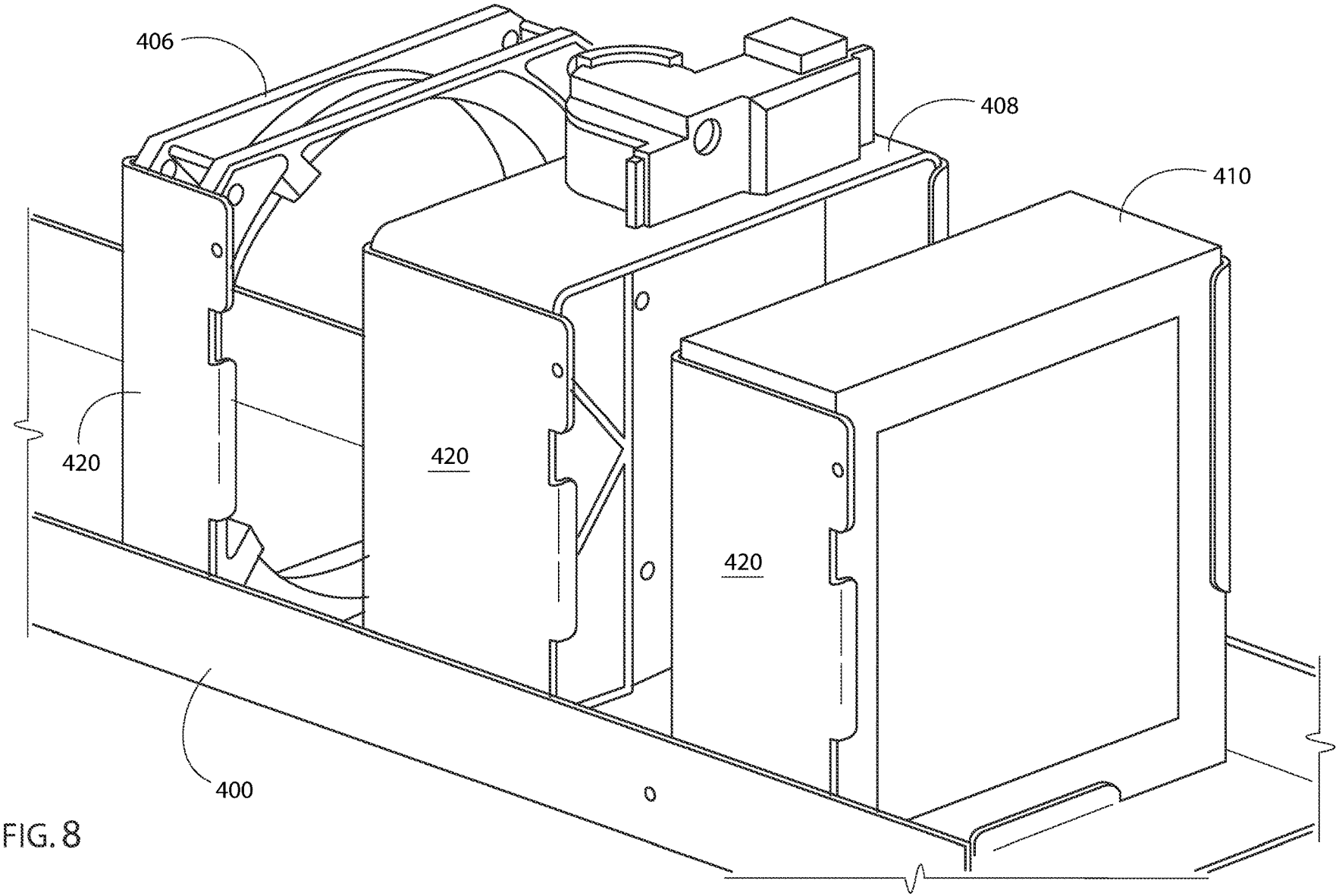
FIG. 8 provides a perspective view of the plurality of brackets where each bracket has a make-up air component received therein.

Turning now to FIG. 7, portions, e.g., sides, of the duct 400 are removed to more clearly illustrated the plurality of brackets 420 therein. In various embodiments, the brackets 420 may be fixed in place within the make-up air duct 400, such as fixed to the duct 400, e.g., bolted, riveted, and/or welded to the make-up air duct 400, or otherwise fixed to the duct 400. In some embodiments, the bracket 420 (or each bracket 420 in embodiments with more than one bracket 420) may include a U-shaped body, e.g., defined by three walls of the bracket 420, such as a bottom wall 422 and a pair of side walls 424 and 426, as described in more detail below. In such embodiments, each make-up air component may be slidably received in the corresponding bracket 420 through an open side or opening 440 defined by the U-shaped body of the corresponding bracket 420. For example, the bracket 420 or each bracket 420 may include a bottom wall 422, a first side wall 424 generally perpendicular to the bottom wall 422, a second side wall 426 generally parallel to the first side wall 424, and an open side 440. The open side 440 of the bracket 420 may be defined opposite the bottom wall 422 of the bracket 420 and between the first side wall 424 and the second side wall 426. In such embodiments, when the make-up air components 406, 408, and 410 are received within the respective brackets 420, e.g., as illustrated in FIG. 8, each make-up air component is positioned between the bottom wall 422, the first side wall 424, and the second side wall 426 of the corresponding bracket 420, whereby each make-up air component is removable from the corresponding bracket 420 through the open side 440 of the corresponding bracket 420.

In some embodiments, each bracket 420 of the plurality of brackets 420 includes a bottom wall 422 extending generally perpendicular to the vertical direction V, a first side wall 424 extending generally perpendicular to the bottom wall 422, a second side wall 426 extending generally perpendicular to the bottom wall 422 and generally parallel to the first side wall 424, e.g., the first and second side walls 424 and 426 may extend generally along the vertical direction V. Each bracket 420 may also include at least one front lip 428 extending generally perpendicularly from a front edge of at least one of the bottom wall 422, the first side wall 424, and/or the second side wall 426, and a back lip 432 extending generally perpendicularly from a back edge of one of the walls 422, 424, 426, e.g., the same wall as the front lip 428 in some embodiments or a different one of the walls 422, 424, 426 in other embodiments. Thus, when the make-up air components 406, 408, and 410 are received within the brackets 420 (and the cover or covers 416 and 418 are not installed on the duct 400), e.g., as illustrated in FIG. 8, each make-up air component, e.g., each of the fan 406, damper 408, and filter 410, is constrained within and by the corresponding bracket 420 along the lateral direction L by the first side wall 424 and the second side wall 426 of the corresponding bracket 420 and along the transverse direction T by the front lip 428 and the back lip 430 of the corresponding bracket 420. As mentioned above, each make-up air component is not constrained by the bracket 420 in at least one direction generally parallel to the vertical direction V, such as upward along the vertical direction V.

In some embodiments, the first side wall 424 of each bracket 420 may extend upward along the vertical direction V from a first end 442 of the bottom wall 422 of the bracket 420 and the second side wall 426 of the bracket 420 may extend upward along the vertical direction V from a second end 444 (FIG. 4) of the bottom wall 422 of the bracket 420 opposite the first end 442 of the bottom wall 422 of the bracket 420.

As mentioned above, the bracket 420 (or each bracket 420 in embodiments where multiple brackets 420 are provided) may include at least one front lip and at least one back lip. In some embodiments, the bracket 420 may include a first front lip 428 extending along the lateral direction L from the first side wall 424 towards the second side wall 426, a first back lip 430 extending along the lateral direction L from the first side wall 424 towards the second side wall 426, a second front lip 436 extending along the lateral direction L from the second side wall 426 towards the first side wall 424, a second back lip 438 extending along the lateral direction L from the second side wall 426 towards the first side wall 424, a third front lip 432 extending from the bottom wall 422, e.g., upwards along the vertical direction V, between the first side wall 424 and the second side wall 426, and a third back lip 434 extending from the bottom wall 422, e.g., upwards along the vertical direction V, between the first side wall 424 and the second side wall 426.

Figure 9:
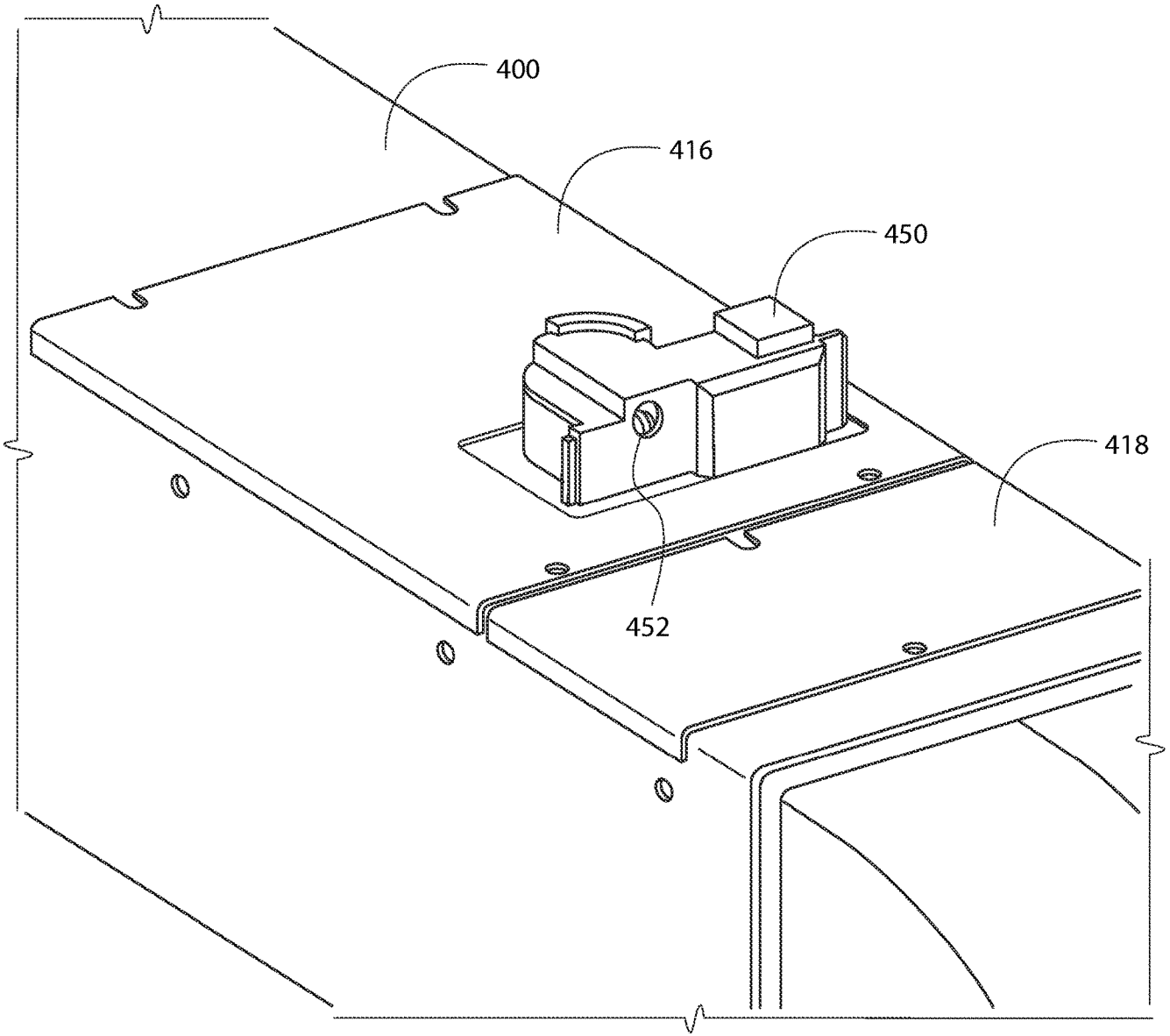
FIG. 9 provides an enlarged perspective view of a damper of the make-up air system in a fully installed position.

As illustrated in FIG. 9, in some embodiments, the damper 408 may include an actuator 454 (see, e.g., FIGS. 12 and 13) enclosed within a housing 450. When the damper 408 is installed within the corresponding bracket 420 and held in place within the duct 400 and bracket 420 by the cover 416, the housing 450 may extend through the cover 416, e.g. above the cover 416 as illustrated in FIG. 9. Thus, the housing 450 may be visible when the damper 408 is fully installed within the duct 400. The housing 450 may also include a service window 452 which may be configured to provide a visual indication of a status, e.g., open or closed, of the damper 408 when the damper 408 is in the fully installed position.

Figure 10:
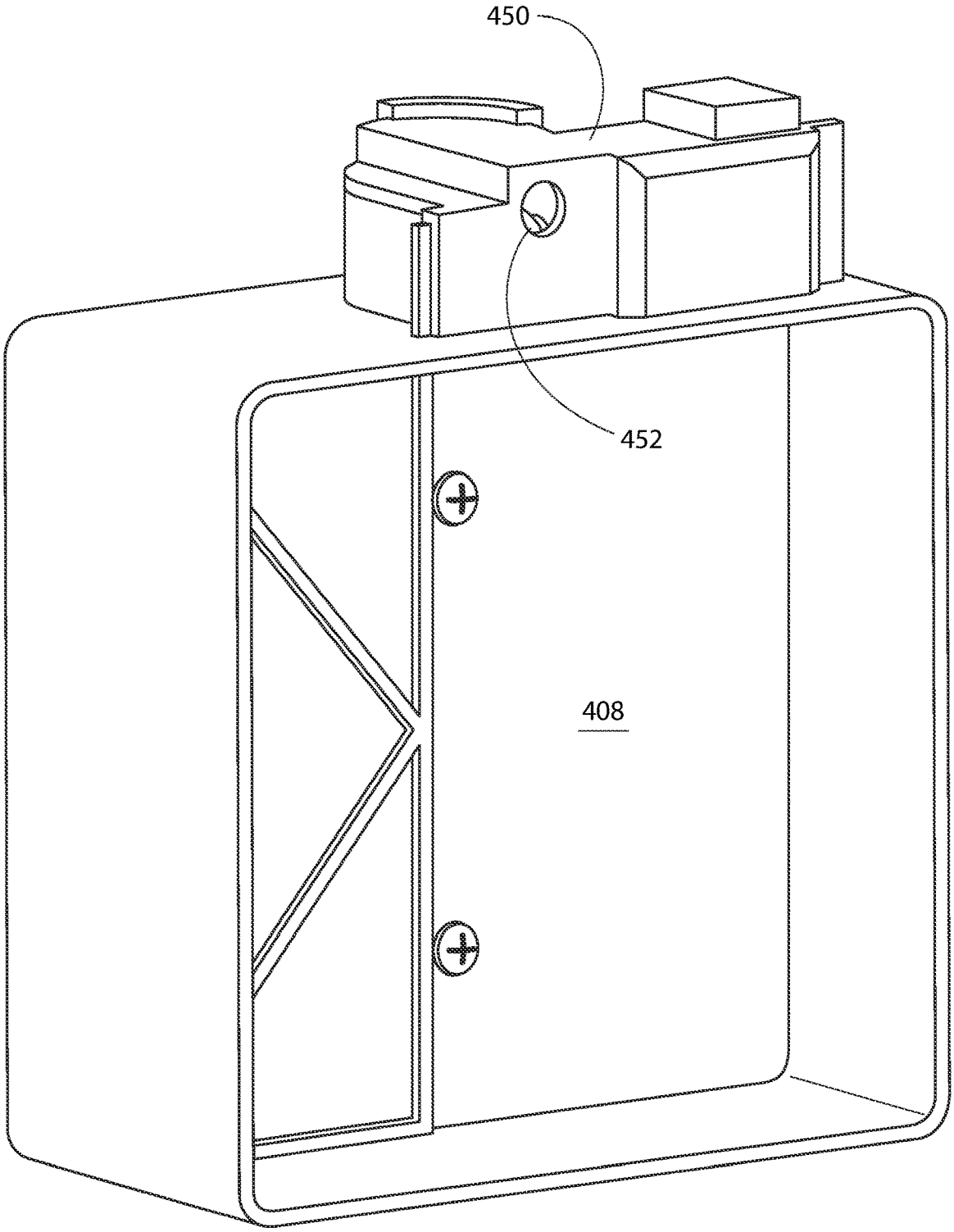
FIG. 10 provides a perspective view of the damper in a closed position.
Figure 11:
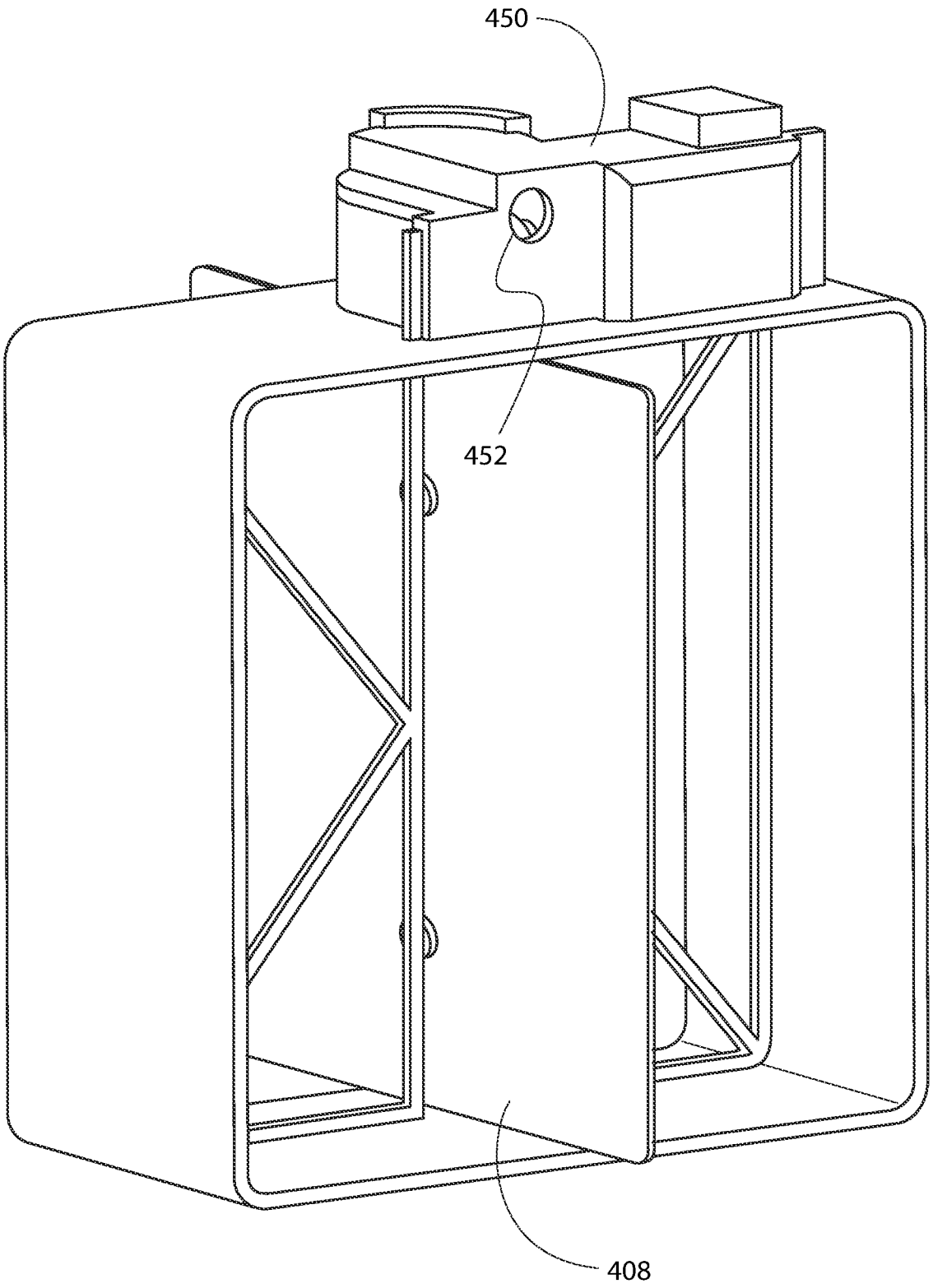
FIG. 11 provides a perspective view of the damper in an open position.
Figure 12:
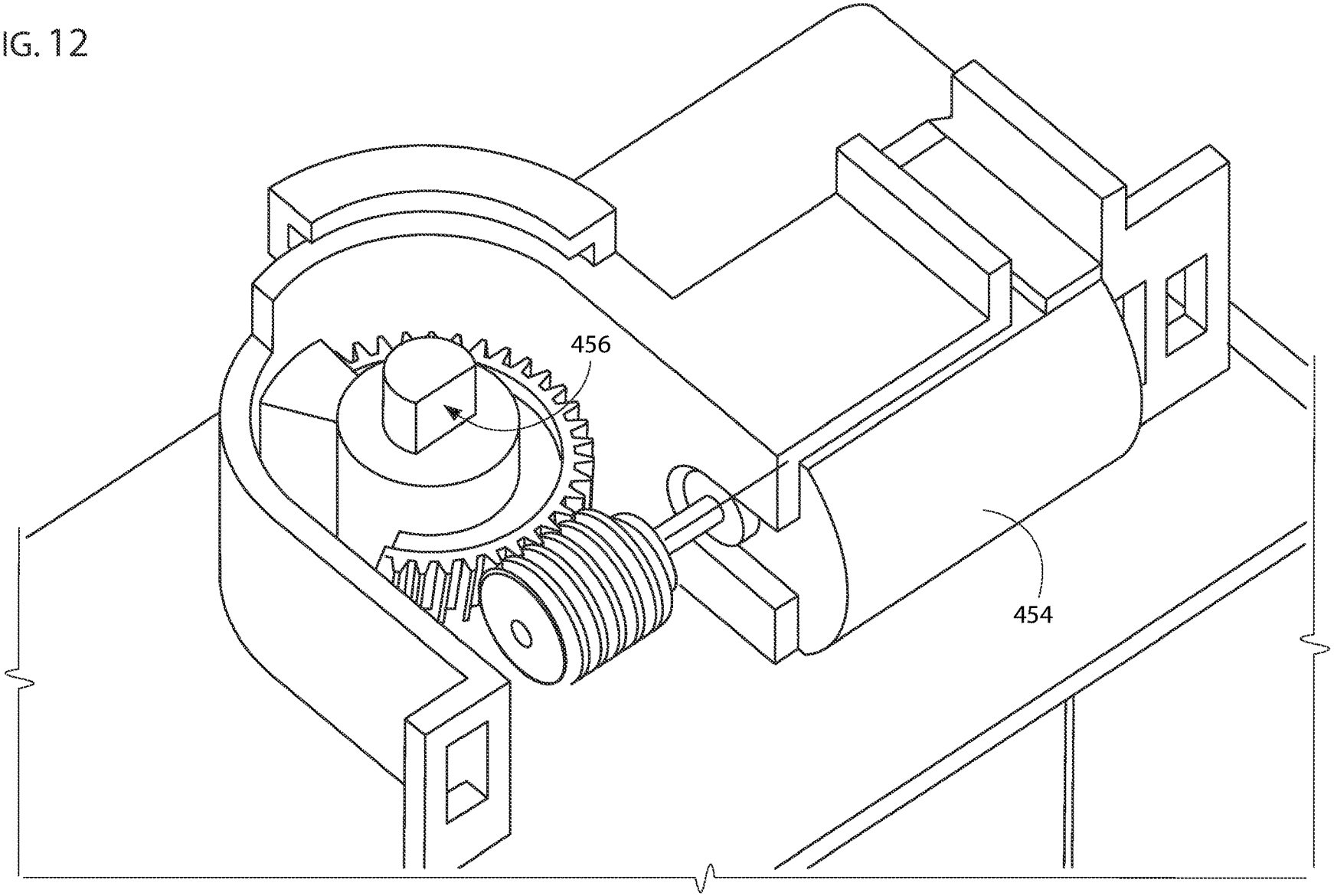
FIG. 12 provides a perspective view of an actuator of the damper when the damper is in the closed position.
Figure 13:
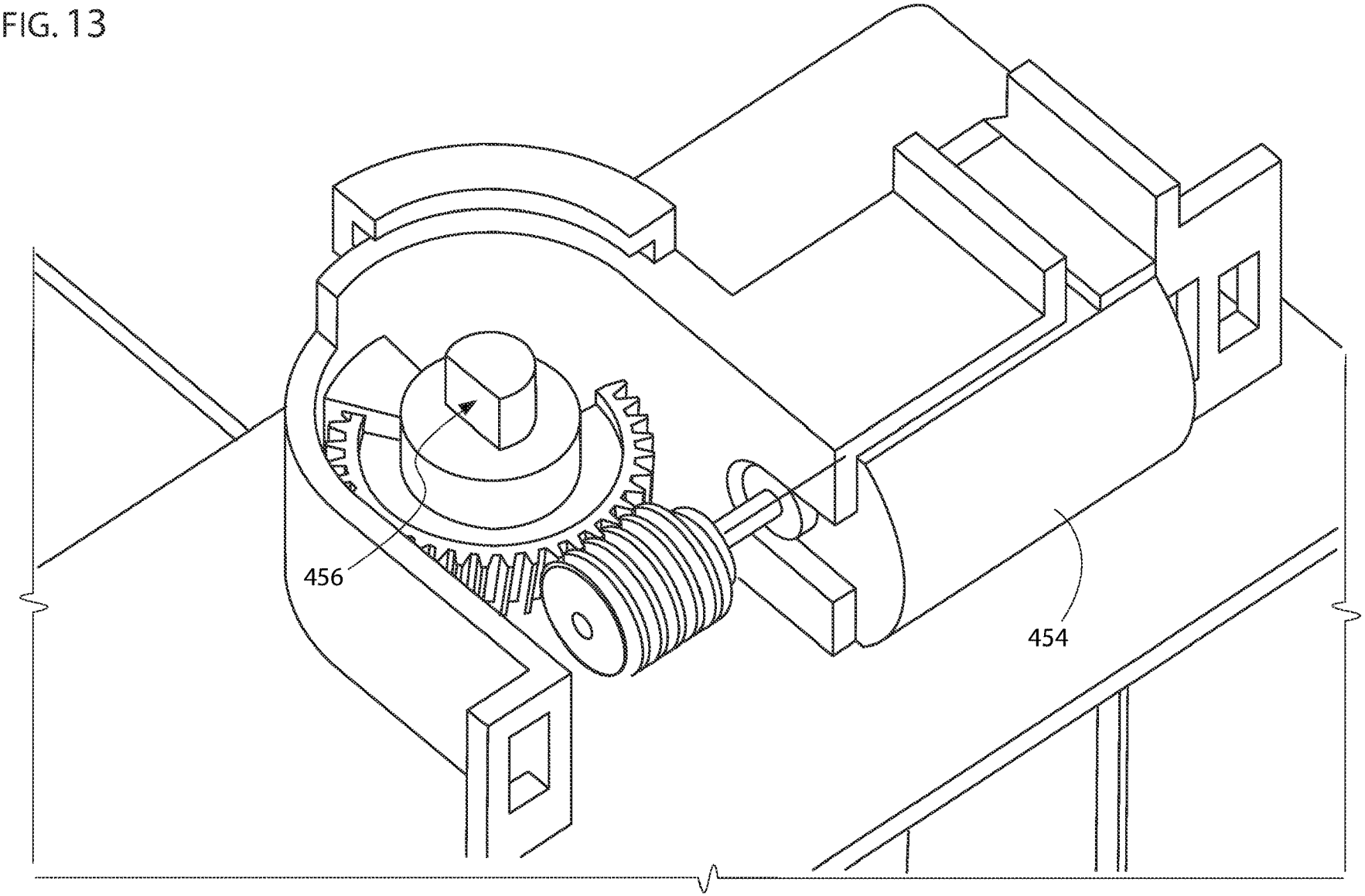
FIG. 13 provides a perspective view of the actuator of the damper when the damper is in the open position.

FIG. 10 provides a perspective illustration of an exemplary damper 408 in a closed position. FIG. 11 provides a similar view of the exemplary damper 408 in an open position. FIG. 12 illustrates a perspective view of the exemplary damper 408 with the housing 450 removed to more clearly depict an actuator 454, which in this example embodiment is a motorized actuator comprising a motor that drives a worm gear to rotate a partially circular gear coupled to a blade of the damper 408 to move, e.g., rotate, the blade between the closed position (see, e.g., FIG. 10) and the open position (see, e.g., FIG. 11). FIG. 13 illustrates a perspective view of the actuator 454 in an open position. As may be seen from FIGS. 12 and 13, the actuator 454 includes a flat face 456 and the flat face 456 is oriented generally along a first direction, e.g., the lateral direction L, when the damper 408 is in the closed position (see, e.g., FIGS. 10 and 12) and is oriented generally along a second direction perpendicular to the first direction, e.g., the transverse direction T, when the damper 408 is in the open position (see, e.g., FIGS. 11 and 13).

Figure 14:
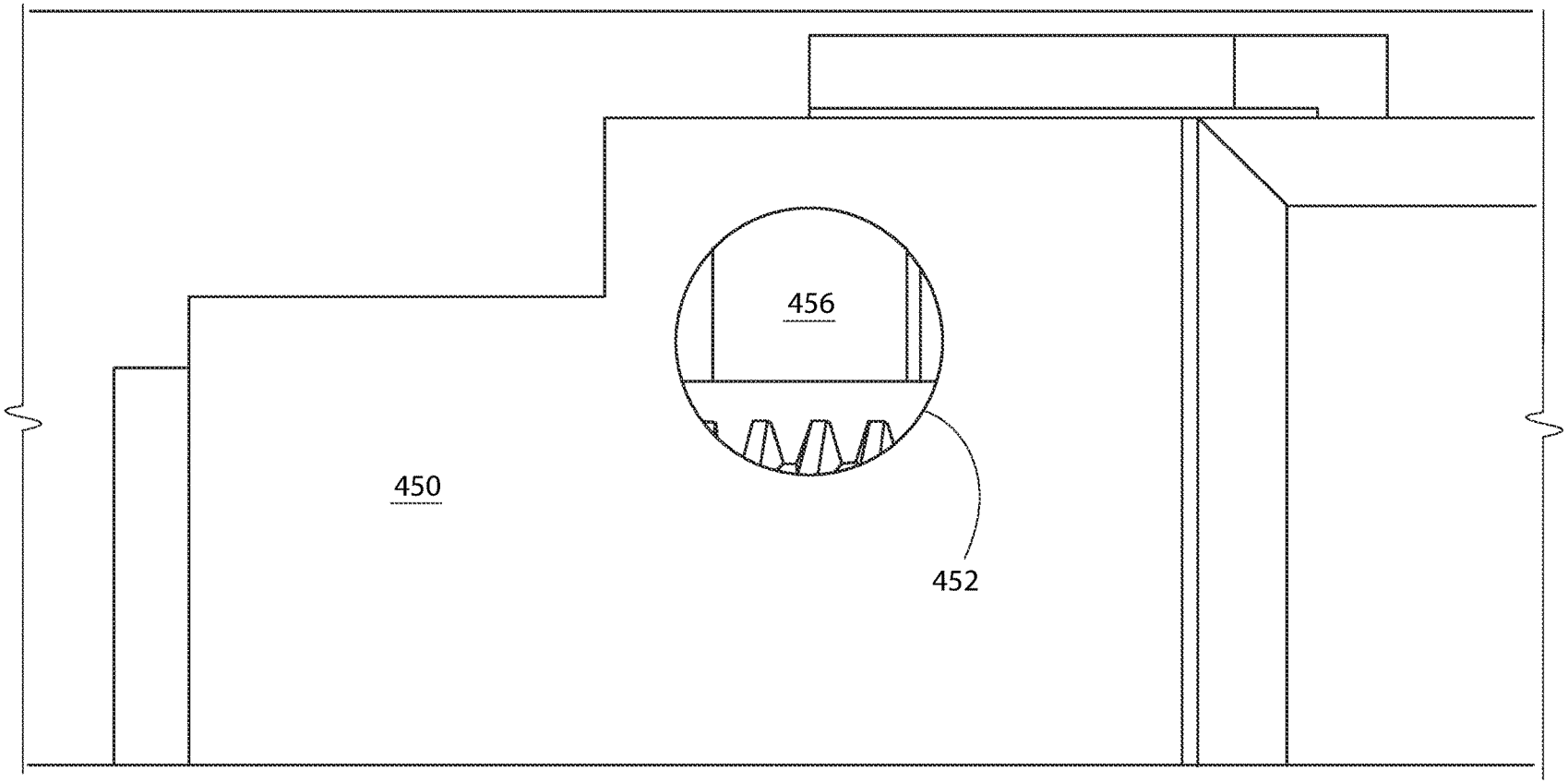
FIG. 14 provides a view through a service window of the damper when the damper is in the closed position.
Figure 15:
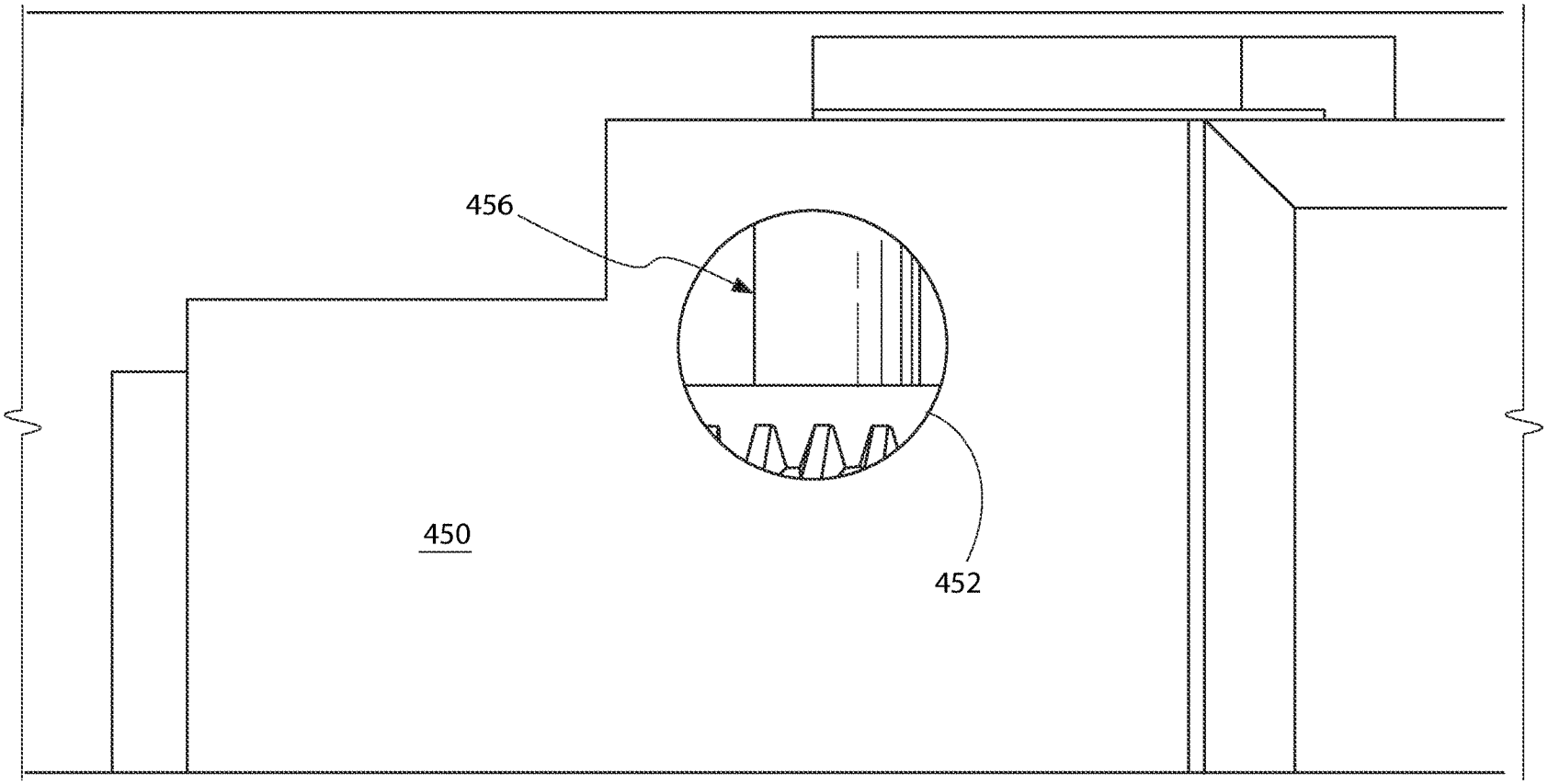
FIG. 15 provides a view through the service window of the damper when the damper is in the open position.

Turning now to FIGS. 14 and 15, FIG. 14 provides a view through the service window 452 when the damper 408 is in the closed position and FIG. 15 provides a view through the service window 452 when the damper 408 is in the open position. As may be seen by comparing FIGS. 14 and 15, a portion of the motorized actuator 454, e.g., including the flat face 456, is aligned with the service window 452 such that the position of the damper 408 may be visually ascertained through the service window 452. For example, when the damper 408 is in the closed position, the flat face 456 faces the service window 452 and may be directly seen through the service window 452, as illustrated in FIG. 14. In such example embodiments, when the damper 408 is in the open position the flat face 456 faces away from the service window 452, such that only an edge of the flat face 456 may be seen through the service window 452, e.g., as illustrated in FIG. 15, or, in additional embodiments, the flat face 456 may not be visible through the service window 452 at all when the damper 408 is in the open position. Thus, by looking through the service window 452, it may be ascertained whether the damper 408 is in the open position or in the closed position based on whether or to what extend the flat face 456 of the actuator 454 is visible through the service window 452.

The make-up air assembly of the present disclosure provides numerous advantages as will be appreciated by those of ordinary skill in the art. For example, the make-up air assembly may be easily repaired or maintained, such as by replacing the filter 410 simply by removing the second cover 418, sliding the old or clogged filter 410 out, sliding a new filter 410 in, and then reattaching the cover 418 to the duct 400 over the opening 414. As another example the damper 408 and/or fan 406 may similarly be accessed for repair or replacement by removing the cover 416, etc. For yet another example of such advantages of the present modular make-up air system, the system may also provide reduced cost of manufacturing and greater design flexibility. For example, the size or location of one or more of the make-up air components may be redesigned (or components may be added to or removed from the design) and the only further change to accommodate such redesign may be to change the corresponding bracket, without having to make any changes to the design of the duct 400 or any other component of the make-up air assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a mutually-perpendicular vertical direction, lateral direction, and transverse direction, the air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a plenum attached to the housing, the plenum receivable within a wall channel defined by a structure wall along an axial direction;

a make-up air duct extending between the plenum and the indoor portion of the housing;

a plurality of brackets fixed in place within the make-up air duct; and a plurality of make-up air components, each make-up air component of the plurality of make-up air components slidably received in one corresponding bracket of the plurality of brackets, wherein the make-up air components are each removable from the corresponding bracket of the plurality of brackets, wherein the plurality of make-up air components comprises at least one fan, a filter, and a damper.

2. The air conditioner unit of claim 1, wherein each bracket of the plurality of brackets comprises a bottom wall extending generally perpendicular to the vertical direction, a first side wall extending generally perpendicular to the bottom wall, a second side wall extending generally perpendicular to the bottom wall, a front lip extending generally perpendicularly from one of the bottom wall, the first side wall, and the second side wall, and a back lip extending generally perpendicularly from one of the bottom wall, the first side wall, and the second side wall, whereby each make-up air component is constrained within and by the corresponding bracket along the lateral direction by the first side wall and the second side wall of the corresponding bracket and along the transverse direction by the front lip and the back lip of the corresponding bracket, and each make-up air component is not constrained by the bracket in at least one direction generally parallel to the vertical direction.

3. The air conditioner unit of claim 2, wherein the first side wall of each bracket extends upward along the vertical direction from a first end of the bottom wall of the bracket and the second side wall of the bracket extends upward along the vertical direction from a second end of the bottom wall of the bracket opposite the first end of the bottom wall of the bracket.

4. The air conditioner unit of claim 2, wherein the front lip extends generally perpendicularly from one of the bottom wall, the first side wall, and the second side wall at a front edge of the one of the bottom wall, the first side wall, and the second side wall, and wherein the back lip extends generally perpendicularly from the one of the bottom wall, the first side wall, and the second side wall at a back edge of the one of the bottom wall, the first side wall, and the second side wall opposite the front edge of the one of the bottom wall, the first side wall, and the second side wall.

5. The air conditioner unit of claim 2, wherein the front lip is a first front lip extending along the lateral direction from the first side wall towards the second side wall, the back lip is a first back lip extending along the lateral direction from the first side wall towards the second side wall, further comprising a second front lip extending along the lateral direction from the second side wall towards the first side wall, a second back lip extending along the lateral direction from the second side wall towards the first side wall, a third front lip extending from the bottom wall between the first side wall and the second side wall, and a third back lip extending from the bottom wall between the first side wall and the second side wall.

6. The air conditioner unit of claim 1, wherein the make-up air duct comprises an opening, the plurality of make-up air components slidably receivable in and removable from the plurality of brackets through the opening, further comprising a cover removably attached to the make-up air duct at the opening, whereby the plurality of make-up air components are held in place within the make-up air duct at least in part by the cover.

7. The air conditioner unit of claim 1, wherein each bracket of the plurality of brackets comprises a U-shaped body and wherein each make-up air component of the plurality of make-up air components is slidably received in the corresponding bracket of the plurality of brackets through an opening defined by the U-shaped body of the corresponding bracket.

8. The air conditioner unit of claim 1, wherein each bracket of the plurality of brackets comprises a bottom wall, a first side wall generally perpendicular to the bottom wall, a second side wall generally parallel to the first side wall, and an open side defined opposite the bottom wall and between the first side wall and the second side wall, wherein each make-up air component is positioned between the bottom wall, the first side wall, and the second side wall of the corresponding bracket, whereby each make-up air component is removable from the corresponding bracket through the open side of the corresponding bracket.

9. The air conditioner unit of claim 1, wherein the damper is coupled to a motorized actuator, the motorized actuator enclosed within a housing, and the housing comprises a service window, wherein a portion of the motorized actuator is aligned with the service window whereby a position of the damper may be visually ascertained through the service window.

10. An air conditioner unit, comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a plenum attached to the housing, the plenum receivable within a wall channel defined by a structure wall along an axial direction;

a make-up air duct extending between the plenum and the indoor portion of the housing;

a bracket fixed in place within the make-up air duct; and a make-up air component slidably received in the bracket, wherein the make-up air component is slidably removable from the bracket, wherein the make-up air component is a damper coupled to a motorized actuator, the motorized actuator enclosed within a housing, and the housing comprises a service window, wherein a portion of the motorized actuator is aligned with the service window whereby a position of the damper may be visually ascertained through the service window.

11. The air conditioner unit of claim 10, wherein the bracket comprises a bottom wall, a first side wall extending generally perpendicular to the bottom wall, a second side wall extending generally perpendicular to the bottom wall, a front lip extending generally perpendicularly from one of the bottom wall, the first side wall, and the second side wall, and a back lip extending generally perpendicularly from one of the bottom wall, the first side wall, and the second side wall, whereby the make-up air component is constrained within and by the bracket along a first direction by the first side wall and the second side wall of the bracket and along a second direction by the front lip and the back lip of the bracket, and the make-up air component is not constrained by the bracket in at least one direction generally parallel to the first side wall and the second side wall.

12. The air conditioner unit of claim 11, wherein the first side wall of the bracket extends upward from a first end of the bottom wall of the bracket and the second side wall of the bracket extends upward from a second end of the bottom wall of the bracket opposite the first end of the bottom wall of the bracket.

13. The air conditioner unit of claim 11, wherein the front lip extends generally perpendicularly from one of the bottom wall, the first side wall, and the second side wall at a front edge of the one wall, and wherein the back lip extends generally perpendicularly from the one wall at a back edge of the one wall opposite the front edge of the one wall.

14. The air conditioner unit of claim 11, wherein the front lip is a first front lip extending from the first side wall towards the second side wall, the back lip is a first back lip extending from the first side wall towards the second side wall, further comprising a second front lip extending from the second side wall towards the first side wall, a second back lip extending from the second side wall towards the first side wall, a third front lip extending from the bottom wall between the first side wall and the second side wall, and a third back lip extending from the bottom wall between the first side wall and the second side wall.

15. The air conditioner unit of claim 10, wherein the make-up air duct comprises an opening, the make-up air component is slidably receivable in and removable from the bracket through the opening, further comprising a cover removably attached to the make-up air duct at the opening, whereby the make-up air component is held in place within the make-up air duct at least in part by the cover.

16. The air conditioner unit of claim 10, wherein the bracket comprises a U-shaped body and wherein the make-up air component is slidably received in the bracket through an opening defined by the U-shaped body of the bracket.

17. The air conditioner unit of claim 10, wherein the bracket comprises a bottom wall, a first side wall generally perpendicular to the bottom wall, a second side wall generally parallel to the first side wall, and an open side defined opposite the bottom wall and between the first side wall and the second side wall, wherein the make-up air component is positioned between the bottom wall, the first side wall, and the second side wall of the bracket, whereby the make-up air component is removable from the bracket through the open side of the bracket.

18. An air conditioner unit defining a mutually-perpendicular vertical direction, lateral direction, and transverse direction, the air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

a plenum attached to the housing, the plenum receivable within a wall channel defined by a structure wall along an axial direction;

a make-up air duct extending between the plenum and the indoor portion of the housing;

a plurality of brackets fixed in place within the make-up air duct; and a plurality of make-up air components, each make-up air component of the plurality of make-up air components slidably received in one corresponding bracket of the plurality of brackets, wherein the make-up air components are each removable from the corresponding bracket of the plurality of brackets, wherein each bracket of the plurality of brackets comprises a bottom wall extending generally perpendicular to the vertical direction, a first side wall extending generally perpendicular to the bottom wall, a second side wall extending generally perpendicular to the bottom wall, a front lip extending generally perpendicularly from one of the bottom wall, the first side wall, and the second side wall, and a back lip extending generally perpendicularly from one of the bottom wall, the first side wall, and the second side wall, whereby each make-up air component is constrained within and by the corresponding bracket along the lateral direction by the first side wall and the second side wall of the corresponding bracket and along the transverse direction by the front lip and the back lip of the corresponding bracket, and each make-up air component is not constrained by the bracket in at least one direction generally parallel to the vertical direction.

19. The air conditioner unit of claim 18, wherein the first side wall of each bracket extends upward along the vertical direction from a first end of the bottom wall of the bracket and the second side wall of the bracket extends upward along the vertical direction from a second end of the bottom wall of the bracket opposite the first end of the bottom wall of the bracket.

20. The air conditioner unit of claim 18, wherein the front lip extends generally perpendicularly from one of the bottom wall, the first side wall, and the second side wall at a front edge of the one of the bottom wall, the first side wall, and the second side wall, and wherein the back lip extends generally perpendicularly from the one of the bottom wall, the first side wall, and the second side wall at a back edge of the one of the bottom wall, the first side wall, and the second side wall opposite the front edge of the one of the bottom wall, the first side wall, and the second side wall.

* * * * *